US007402051B1

(12) United States Patent
Batish et al.

(10) Patent No.: US 7,402,051 B1
(45) Date of Patent: Jul. 22, 2008

(54) INTERCONNECT ASSEMBLY FOR TESTING INTEGRATED CIRCUIT PACKAGES

(75) Inventors: Rakesh Batish, Phoenixville, PA (US); Richard M. Pointer, Media, PA (US)

(73) Assignee: Antares Advanced Test Technologies, Inc., Vancouver, WA (US)

( * ) Notice: Subject to any disclaimer, the term of this patent is extended or adjusted under 35 U.S.C. 154(b) by 1 day.

(21) Appl. No.: 11/558,603

(22) Filed: Nov. 10, 2006
(Under 37 CFR 1.47)

Related U.S. Application Data

(60) Provisional application No. 60/735,939, filed on Nov. 10, 2005.

(51) Int. Cl.
*H01R 12/00* (2006.01)

(52) U.S. Cl. ..... 439/66; 439/91

(58) Field of Classification Search ..... 439/66, 439/91, 591
See application file for complete search history.

(56) References Cited

U.S. PATENT DOCUMENTS

| | | | | |
|---|---|---|---|---|
| 6,565,395 | B1 * | 5/2003 | Schwarz | 439/840 |
| 6,685,492 | B2 * | 2/2004 | Winter et al. | 439/219 |
| 6,787,709 | B2 * | 9/2004 | Vinther | 174/260 |
| 6,866,519 | B2 * | 3/2005 | Fan et al. | 439/66 |
| 6,909,056 | B2 * | 6/2005 | Vinther | 174/260 |
| 7,040,902 | B2 * | 5/2006 | Li | 439/66 |
| 7,147,478 | B1 * | 12/2006 | Ju | 439/66 |
| 7,297,004 | B1 * | 11/2007 | Shuhart et al. | 439/66 |
| 2004/0053539 | A1 * | 3/2004 | Watanabe | 439/700 |
| 2005/0266734 | A1 * | 12/2005 | Kazama | 439/700 |
| 2006/0189176 | A1 * | 8/2006 | Li | 439/66 |
| 2006/0211276 | A1 * | 9/2006 | Li | 439/66 |
| 2007/0026699 | A1 * | 2/2007 | Tahahashi et al. | 439/66 |

* cited by examiner

*Primary Examiner*—Gary F. Paumen
(74) *Attorney, Agent, or Firm*—Marger Johnson & McCollom, P.C.

(57) ABSTRACT

An interconnect assembly is provided for electrically connecting first and second circuit members. Each of the circuit members comprises an array of electrical contacts. The interconnect assembly includes a plurality of compressible electrical conductors having opposite ends respectively configured for contacting the electrical contacts of the first and second circuit members. The interconnect assembly also includes a carrier defining a plurality of apertures for receiving the conductors and at least one retainer contacting each conductor. Each of the retainers has a maximum diameter that is greater than a minimum diameter of the apertures such that a portion of each conductor is retained within one of the apertures.

20 Claims, 7 Drawing Sheets

INTERCONNECT ASSEMBLY FOR TESTING INTEGRATED CIRCUIT PACKAGES

CROSS-REFERENCE TO RELATED APPLICATIONS

This application claims priority to and the benefit of U.S. Provisional Patent Application No. 60/735,939 which was filed on Nov. 10, 2005 and entitled "Interconnect Assembly For Testing Integrated Circuit Packages."

FIELD OF THE INVENTION

The present invention relates to integrated circuit (IC) packages and modules, and more particularly, to an interconnect assembly for electrically connecting an IC package or module to another device such as a load board of a package testing system.

BACKGROUND OF THE INVENTION

Certain integrated circuit (IC) packages or modules include semiconductor devices, such as chips or dies, contained in an encapsulating material or housing. The IC package or module includes an exterior array of contacts, or input/output pads, for electrically connecting the package or module to another electronic component, such as a load board adapted for use with a package testing system. The contacts of an IC package typically are not connected directly to the load board. Typically, an interconnect assembly (e.g., a test socket) is interposed between the IC package and the load board to provide electrical connection between the contact array of the IC package and a contact array of the load board.

Referring to FIG. 1, there is shown a prior interconnect assembly 100 located between an IC package 102 and a load board 104 adapted for use with a package testing system. The IC package 102 includes an array of electrical contacts 108 located on an exterior surface of the package. The exemplary array of contacts 108 is of a type known as a "land grid array" in which the contacts 108 have substantially planar contact surfaces. The load board 104 also includes an array of electrical contacts 110.

The interconnect assembly 100 includes a plurality of conductors 112 received in openings 116 defined by a support frame or carrier 114. As shown, the openings 116 of the carrier 114 are spaced to provide for substantial alignment between the conductors 112 and the contacts 108, 110 of the package 102 and the load board 104, respectively. Each of the conductors 112 is compressible to provide a variable length for the conductor 112. Such adjustable conductor length allows the interconnect assembly 100 to accommodate dimensional variations, amongst the contacts 108, 110 for example. Such dimensional variation results in variation in the separating distance between pairs of contacts 108, 110 when the package 102 and the load board 104 are brought into contact with the interconnect assembly 100 as shown in FIG. 1. The adjustable length for the conductors 112 ensures that each of the conductors 112 of the interconnect assembly 100 will contact the package 102 and the load board 104.

Each conductor 112 of the interconnect assembly 100 includes plunger members 118, 120 defining opposite ends of the conductor and a cylindrical barrel 122 located between the plunger members 118, 120. A coil spring or other resilient member (not shown) is coupled between the plunger members 118, 120 and contained within the barrel 122. Compression of the coil spring under loading placed on the plunger members 118, 120 results in the desired shortening of the distance between opposite ends of the conductor 112. This type of conductor having elongated plungers, a barrel and a coil spring is sometimes referred to as a "spring pin" or "pogo pin."

The carrier 114 of the prior interconnect assembly 100 includes a socket portion 124 and a retainer portion 126 secured together by fasteners at locations 128. The carrier 114 of prior interconnect assembly 100 can be secured to the load board 104 by fasteners at locations 130. Each of the carrier portions 124, 126 defines an annular shoulder 132 adjacent the openings 116 for retaining the barrels 122 of the conductors 112 within the openings 116. As illustrated in FIG. 1, the barrel 122 of each conductor 112 is dimensioned to define a gap between the conductor 112 and the annular shoulders 132. This gap provides vertical play between the carrier 114 and the barrels 122 of conductors 112.

Referring to FIG. 2, the interconnect assembly 100 of FIG. 1 is located between a load board 104 and an IC package 134. Instead of including a land grid array of contacts like package 102, package 134 includes an array of contacts 138 having a rounded configuration. This type of contact array is sometimes referred to as a "ball grid array."

SUMMARY OF THE INVENTION

According to an exemplary embodiment of the invention, an interconnect assembly is provided for electrically connecting first and second circuit members. Each of the circuit members comprises an array of electrical contacts. The interconnect assembly comprises a plurality of compressible electrical conductors having opposite ends respectively configured for contacting the electrical contacts of the first and second circuit members. The interconnect assembly also comprises a conductor carrier defining a plurality of apertures for receiving the conductors. The interconnect assembly further comprises at least one conductor retainer contacting each conductor at a preselected location on the conductor. Each of the conductor retainers has a maximum diameter that is greater than a minimum diameter of the apertures such that a portion of each of the conductors is retained within one of the apertures. Accordingly, suitable conductor retainers are configured to attach to a conductor and positionally secure the conductor relative to an aperture in a conductor carrier.

According to another exemplary embodiment of the invention, an interconnect assembly is provided for electrically connecting a semiconductor package to a load board configured for use with a package testing system. Each of the package and the load board comprises an array of electrical contacts. The interconnect assembly comprises a plurality of compressible electrical conductors having opposite ends respectively configured for contacting the electrical contacts of the package and the load board. The interconnect assembly also comprises a carrier defining a plurality of apertures each configured for receiving one of the conductors. The interconnect assembly further comprises a plurality of retainers each contacting one of the conductors and located within one of the apertures of the carrier. Each of the retainers has a maximum diameter that is greater than a minimum diameter of the carrier apertures such that each of the conductors is retained by the carrier. Accordingly, a suitable conductor carrier is configured to be attached to a conductor and to be seated within a recess formed in the carrier to secure the conductor against axial movement in at least one direction.

According to another exemplary embodiment of the present invention, an interconnect assembly is provided for electrically connecting first and second circuit members. Each of the circuit members comprises an array of electrical contacts. The interconnect assembly comprises a plurality of electrical conductors having opposite ends configured for contacting the electrical contacts of the first and second circuit members. Each of the conductors comprises a compressible body defining a plurality of openings and an interior. The interconnect assembly also comprises a carrier defining a plurality of apertures configured for receipt of the conductors. The interconnect assembly further comprises a plurality of insert members each received within the interior of the body of one of the conductors. The insert member is configured such that an adjacent portion of the conductor body is outwardly expanded to a maximum diameter that is greater than a minimum diameter of the carrier apertures. Accordingly, a suitable insert member may be configured for insertion within and expansion of a conductor to secure the conductor within a carrier aperture.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features may be expanded or reduced for clarity. Included in the drawing are the following figures.

DETAILED DESCRIPTION OF THE DRAWINGS

The following description is of certain exemplary embodiments of the present invention only, and is not intended to limit the scope, applicability or configuration of the invention. Rather, the following description is intended to provide a convenient illustration for implementing various embodiments of the invention. As will become apparent, various changes may be made in the function and arrangement of the elements described in these embodiments without limiting or diminishing the scope of the invention as set forth herein. It should be appreciated that the description herein may be adapted to be employed with alternatively configured devices having different shapes, components, materials and the like and still fall within the scope of the present invention. Thus, the detailed description herein is presented for purposes of illustration only and not of limitation.

As used herein, the term "semiconductor package" refers to an assembly including at least one semiconductor device (e.g., a chip) supported on a substrate (e.g., a circuit board).

As used herein, the terms "lattice" or "lattice-like" as applied to a conductor refers to a construction of elongated members (e.g., wires) that are arranged to cross each other such that a plurality of openings, or interstices, are defined between the elongated members. The terms "lattice" or "lattice-like", however, are not meant to require any bonding or mechanical coupling between the elongated members at the locations where the members cross each other.

Figure 3:
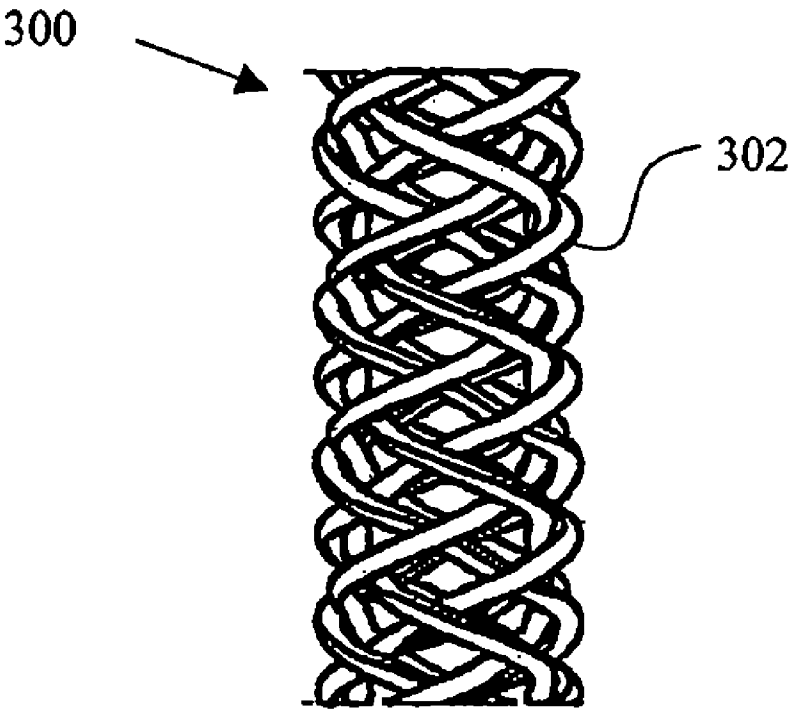
FIG. 3 is a side view of an electrical conductor according to an exemplary embodiment of the invention for use with an interconnect assembly for electrically connecting circuit members.

Referring again to the drawings where like numerals refer to like elements, there is illustrated in FIG. 3 a compressible member such as a compressible electrical conductor 300 for an interconnect assembly according to an exemplary embodiment of the invention for electrically connecting circuit members (e.g., a semiconductor package and a load board). The depicted exemplary compressible electrical conductor 300 comprises eight discrete wires 302 interlaced with each other, such as by braiding, weaving, or wrapping the wires, to form a substantially tubular structure. The tubular structure need not be circular or uniform, but rather defines an elongated interior space. The interlacing of the wires 302 results in a lattice-like construction in which the wires cross each other defining a plurality of openings between the wires. The openings may be relatively large as with a net-like mesh or may be non-visible as with a tightly woven mesh. Each of the interlaced wires 302 of the depicted compressible electrical conductor 300 is deformed during fabrication of the conductor to extend along a helical path. In this embodiment wires 302 undergo primarily elastic deformation during manufacture such that plastic deformation is minimized.

The interlaced wires 302 are then annealed during manufacture of the compressible electrical conductor 300 to provide stress relief, particularly at the locations where adjacent wires 302 overlap each other. In the exemplary embodiment illustrated in FIG. 3, there is no bonding or other mechanical interconnection between the wires 302 such that the wires remain free to move (e.g., slide) with respect to each other when conductor 300 is compressed under an applied load. In accordance with other exemplary embodiments of the present invention, any portion of compressible electrical conductor 300 may include bonding or mechanical interconnection between the wires 302 or conductive or insulative coatings along any portion of the compressible electrical conductor 300. For example, an end portion or the compressible electrical conductor 300 may be bonded or mechanically interconnected, as with a plastic or soldered collar, to restrict unraveling or deflection of the wires 302. The ends of the wires 302 may also be coated or reinforced, for example using highly conductive metals, to unify multi-filament wires or to increase the surface area for contacting adjacent electrical contacts.

Similarly, the stress relief provided by the annealing removes associated elastic strain within the wires 302, such that the wires will tend to remain together in the unitary, tubular, construction shown rather than springing apart when a length of the interlaced-wire construction is cut to provide individual conductors, such as compressible electrical conductor 300 of FIG. 3, of desired length.

The tubular construction of the depicted compressible electrical conductor 300 desirably provides a simplified construction configured to compress substantially uniformly along the length of the conductor, or uniformly along the compressible portion of the conductor. This simplified construction having a reduced number of parts and reduced number of electrical interfaces between parts provides advantages in efficiency of manufacture and reliability and durability during use.

It should be understood that the present invention is not limited to the depicted compressible electrical conductor 300. A compressible electrical conductor may be constructed using any materials and any construction techniques to create a compressible electrical connector that is configured to compress under axial force and restore to its original size when the force is removed. In one such exemplary embodiment, an interlaced-wire tube may include more, or fewer, than eight wires. In another embodiment, the conductor may be made from flat meshes of interlaced wire that are rolled into a tubular form. For example, compressible electrical conductor 300 may comprise a tightly woven mesh (e.g. without visible openings) and still be configured to provide sufficient elastic response to compressive forces. Wires 302 need not be free at the ends of compressible electrical conductor 300 but may be woven back into conductor 300, for example as a rim structure around the tubular opening of conductor 300.

In additional embodiments, compressible electrical conductor 300 may be formed from any combination of winding, folding, wrapping, braiding, weaving or the like of wires 302 or rolling, folding, wrapping or the like of mesh sheets made from wires 302. Wires 302 may be selected and configured in any combination within compressible electrical conductor 300 to be of different metals, alloys, sizes, cross-sections, thickness and the like or to exhibit differing elasticity, conductivity or other differing mechanical or electrical properties. In another embodiment, compressible electrical conductor 300 comprises concentric tubes, for example, the outer tube is formed from more pliable wires 302 and the inner tube is formed from stiffer wires 302. Accordingly, compressible electrical conductor 300 may be formed from any suitable combination or configuration of wires 302, whether formed directly from individual wires 302 or from a mesh sheet of wires 302, to provide substantially uniform elastic response to compression forces along the respective conductor length. Furthermore, compressible electrical conductor may be formed from materials other than wires to form a compressible structure capable of conducting electricity.

Figure 4:
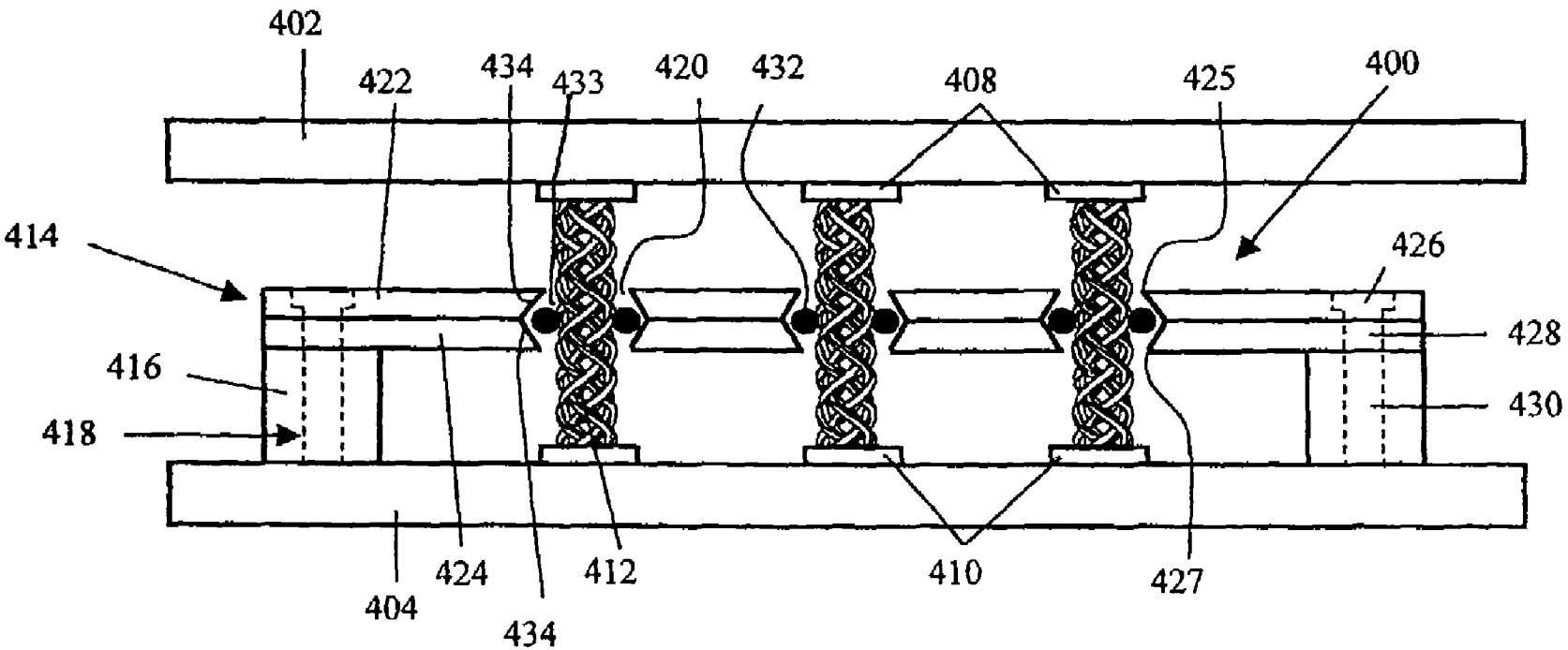
FIG. 4 is a side sectional view of an interconnect assembly according to one exemplary embodiment of the present invention shown electrically connecting circuit members having arrays of electrical contacts.

Referring to FIG. 4, there is shown an interconnect assembly 400 according to an exemplary embodiment of the invention shown electrically connecting two circuit members 402, 404. According to one non-limiting example, the circuit members are respectively a semiconductor package 402 and a load board 404 configured for use with a package testing system. In similar fashion as the package 102 and load board 104 of FIGS. 1 and 2, the package 402 and load board 404 respectively comprise arrays of contacts 408, 410 for engagement with the interconnect assembly 400, as described below in greater detail. It should be understood that the present invention is not limited to use with circuit members having electrical contacts of any particular configuration. The arrays of electrical contacts of the circuit members, for example, may comprise a land grid array (e.g., the array of electrical contacts 108 of package 102 shown in FIG. 1), a ball grid array (e.g., the array of electrical contacts 138 of package 134 shown in FIG. 2), or arrays of electrical contacts having other configurations.

In accordance with an exemplary embodiment of the present invention, the interconnect assembly 400 comprises a plurality of compressible electrical conductors 412. The depicted conductors 412 may, for example, comprise an interlaced-wire construction such as that of the electrical conductor 300 shown in FIG. 3. In this exemplary embodiment, the interconnect assembly 400 comprises a non-conductive carrier 414 for the conductors 412. The carrier 414 maintains the conductors 412 in a spaced relationship that substantially corresponds to the spaced relationship between the contacts 408, 410 of the package 402 and the load board 404, respectively. The arrangement of the conductors 412 in this manner provides for substantial alignment between the conductors 412 and the contacts 408, 410 of the package 402 and load board 404 as shown. The depicted interconnect assembly 400 may also comprise a carrier support member 416 to which the carrier 414 is attached, such as by fasteners at locations 418 for example. Exemplary fasteners comprise screws, pegs, or other known types of fasteners. In accordance with an exemplary embodiment of the present invention, attachment mechanisms may comprise snap attachment constructions, adhesive bonding, soldering, and other known or yet unknown attachment mechanisms.

Figure 1:
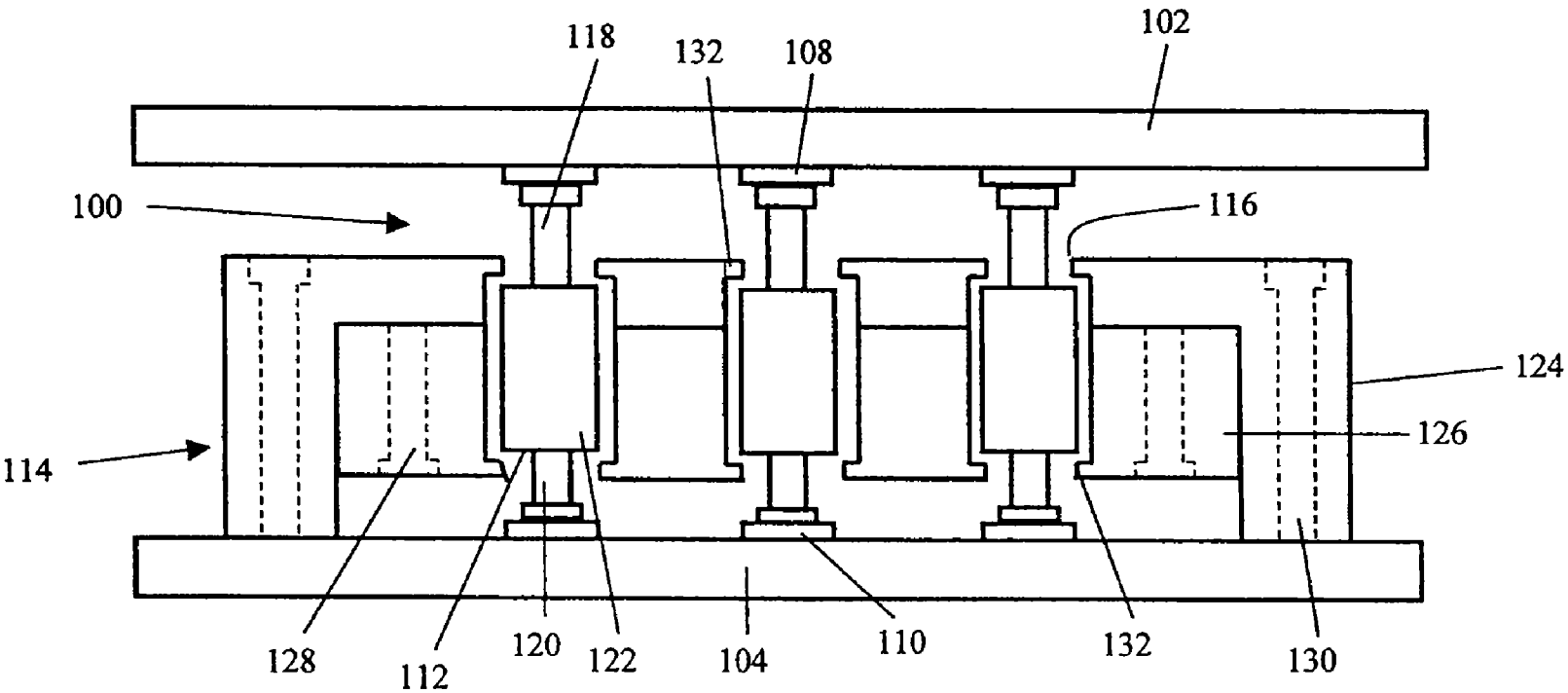
FIG. 1 (Prior Art)
FIG. 1 is a side sectional view of a prior interconnect assembly located between an IC package and a load board configured for use with a package testing system, the IC package having a land grid array of contacts.
Figure 2:
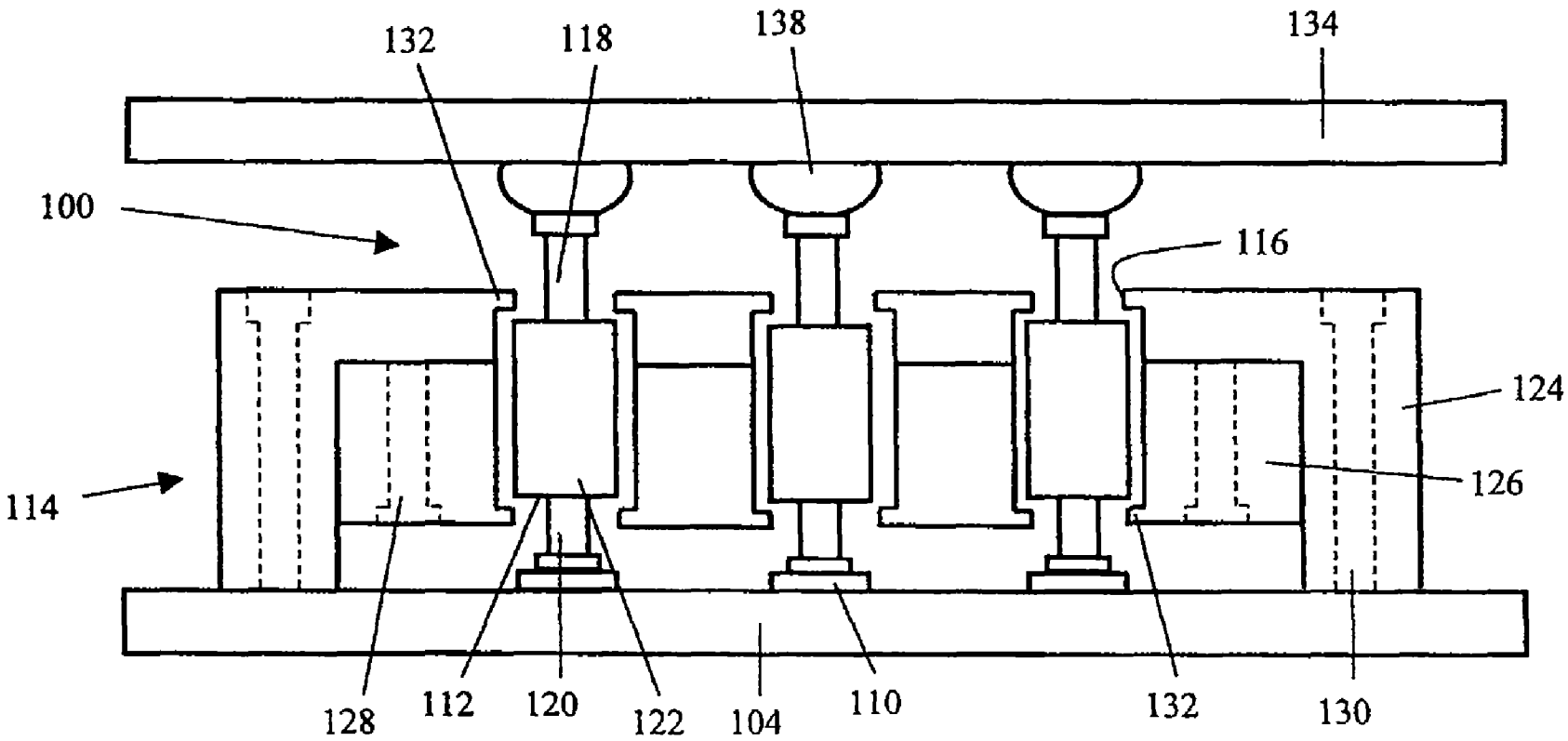
FIG. 2 (Prior Art)
FIG. 2 is a side sectional view of the prior interconnect assembly of FIG. 1 located between the load board of FIG. 1 and an IC package having a ball grid array of contacts.

As described above, the carrier 414 of the depicted interconnect assembly 400 is supported by the carrier support member 416. In accordance with another embodiment, it is contemplated that the carrier may comprise a socket portion that, like the socket portion 124 of FIGS. 1 and 2, is configured for attachment to the load board 404.

In accordance with an exemplary embodiment of the present invention, the carrier 414 defines a plurality of apertures 420 each configured for receipt of one of the compressible conductors 412. The carrier 414 comprises an upper plate 422 and a lower plate 424. As shown, each of the apertures 420 of carrier 414 is defined in part by an aperture 425 in the upper plate 422 and an aperture 427 in the lower plate 424. The upper and lower plates 422, 424 respectively may comprise openings 426, 428 that are substantially aligned with openings 430 in the carrier support member 416 to provide for receipt of fasteners at locations 418. Such fasteners received at locations 418 may be used to attach the upper and lower plates 422, 424 of carrier 414 to each other as well as to attach the carrier 414 to the carrier support member 416. Such fasteners at locations 418 may also be used to attach the carrier support member 416 to the load board 404. Other methods of attaching the upper and lower plates 422, 424 of carrier 414 to each other are contemplated such as snap attachment or adhesive bonding means for example.

In accordance with an exemplary embodiment of the present invention, interconnect assembly 400 also comprises a plurality of conductor retainers 432, such as a resilient O-ring, plastic or metal split ring or crimp ring for example, received on each of the conductors 412. The receipt of the conductor retainers 432 on the conductors 412 preferably generates compressive forces between the conductors 412 and the retainers 432. Such compressive forces provide a desirable gripping feature by which each of the conductor retainers 432 is capable of being retained at a preselected location on an associated one of the conductors 412 at which the retainer 432 has been positioned. In accordance with another exemplary embodiment, such compressive forces may be generated by interference between the conductor retainers 432 and apertures 420.

In various embodiments, upper and lower plates 422, 424 together define a recess 433 within apertures 420. While recess 433 may be radiused, tiered, beveled or the like, the depicted carrier 414 embodiment defines beveled surfaces 434 on each of the upper and lower plates 422, 424 at the apertures 420. As shown in FIG. 4, the beveled surfaces 434 define a diameter for recess 433 in aperture 420 that increases to a maximum value at an interface between the plates 422, 424 from minimum values at the exterior surfaces of plates 422, 424. In this manner, the beveled surfaces 434 collectively define recess 433 at each aperture 420 that is configured to accommodate one of the conductor retainers 432. As shown, however, the beveled surfaces 434 are configured such that the minimum diameter of each aperture 420 at the exterior surfaces of plates 422, 424 is less than a maximum diameter of the associated conductor retainer 432 in its received condition on one of the conductors 412. As such, the beveled surfaces 434 of the upper and lower plates 422, 424 of carrier 414 are configured to retain the conductor retainers 432 within the apertures 420, thereby retaining the conductors 412 within the apertures 420.

Any suitable method of providing the apertures 420 in carrier 414 may be used. For example, the beveled surfaces 434 or recesses 433 of apertures 420 may be created by machining each of the upper and lower plates 422, 424. Alternatively, a lithographic process may be used to build up the upper and lower plates 422, 424 in a layered fashion or an etching process may be used to remove portions of the plates 422, 424. Alternatively, recesses 433 and apertures 420 may be suitably formed in a single unitary carrier plate.

According to an exemplary assembly method, the interconnect assembly 400 may be assembled in the following manner. First, a conductor retainer 432 is placed on each of the conductors 412 of the interconnect assembly 400 such that the retainer 432 is grippingly retained on the conductor 412 at a preselected location on the conductor 412. Next, the conductors 412 are placed into the apertures 427 of the lower plate 424 of carrier 414, the lower plate 424 being separated from the upper plate 422 of carrier 412. The upper plate 422 is then placed with respect to the lower plate 424 such that the conductors 412 are received by the apertures 425 of the upper plate 422, thereby capturing the retainers 432 in the notch-like formations defined by the beveled surfaces 434 such that the conductors 412 are retained within the apertures 420 of carrier 414. The carrier 414, and the retained conductors 412, are then placed with respect to the carrier support member 416 to provide for attachment of the carrier 414 to the carrier support member 416, using fasteners at locations 418 for example.

The above-described assembly method may be modified. For example, the conductors 412 carrying conductor retainers 432 may first be placed into the apertures 425 of the upper plate 422 of carrier 414, while the upper plate 422 is in an inverted position for example to facilitate the placement of the conductors 412. It is also conceivable that the conductors 412 may initially be placed into the apertures 425, 427 of one of the plates 422, 424, respectively, prior to placement of the conductor retainers 432 onto the conductors 412, using a fixture for example to position the conductors 412 with respect to the selected one of the plates 422, 424. Also, as described above, it is conceivable that the upper and lower plates 422, 424 of carrier 414 may be attached to each other (e.g., by fasteners, snap attachment, adhesive, etc.) prior to attachment of the carrier 414 to the carrier support member 416.

The interconnect assembly 400 is shown in FIG. 4 with only three conductors 412 spaced across the carrier 414 to facilitate description. It should be understood, however, that an interconnect assembly according to the invention may comprise an arrangement of conductors that includes a few conductors or many conductors—up to tens of thousands of conductors or more.

Figure 5:
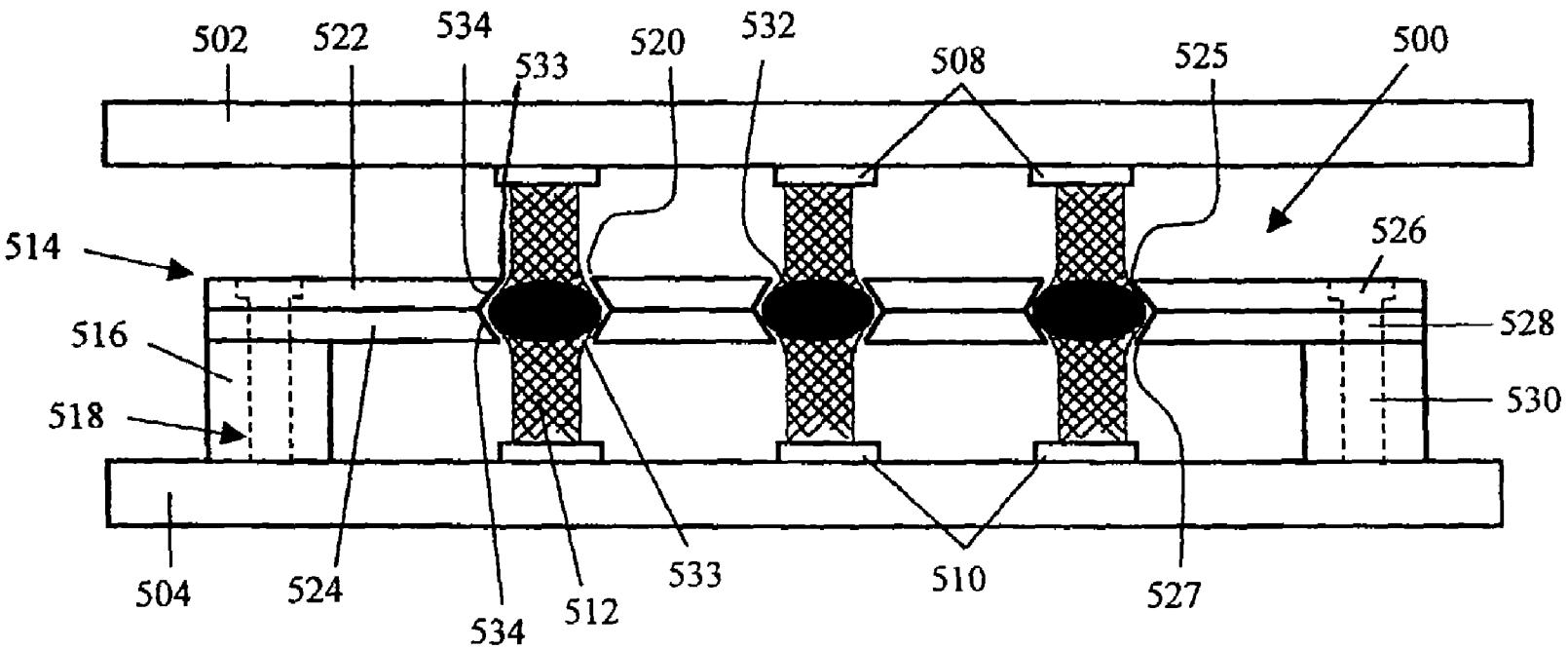
FIG. 5 is a side sectional view of an interconnect assembly according to a second exemplary embodiment of the present invention.

Referring to FIG. 5, there is shown an interconnect assembly 500 according to a second exemplary embodiment of the invention. In accordance with an exemplary embodiment of the present invention, the interconnect assembly 500 is configured to electrically connect first and second circuit members. For example, interconnect assembly 500 may be configured to electrically connect a semiconductor package 502 and a load board 504, wherein load board 504 is configured for use with a package testing system. The package 502 and the load board 504 respectively comprise arrays of contacts 508, 510.

The interconnect assembly 500 comprises a plurality of electrical conductors 512 arranged in a spaced arrangement. The spaced arrangement of the conductors 512 may substantially correspond to a spaced arrangement for the contacts 508, 510, respectively, of the circuit members 502, 504. This arrangement provides for contact between the conductors 512 and the contacts 508, 510, as shown in FIG. 5. In an exemplary embodiment, each conductor 512 comprises a tubular, interlaced-wire, construction such as that of the conductor 300 shown in FIG. 3; however, other types of conductor 300 may be used.

The interconnect assembly 500 comprises a carrier 514 for maintaining the conductors 512 in the spaced relationship substantially corresponding to the spaced relationship between the contacts 508, 510 of the package 502 and the load board 504, respectively. The depicted interconnect assembly 500 may also comprise a carrier support member 516 to which the carrier 514 is attached, such as by fasteners at locations 518 for example.

The carrier 514 may comprise a plurality of apertures 520 configured for receiving the conductors 512. In an exemplary embodiment, the carrier 514 comprises an upper plate 522 and a lower plate 524. Each of the apertures 520 of carrier 414 is defined in part by an aperture 525 in the upper plate 522 and an aperture 527 in the lower plate 524. The upper and lower plates 522, 524 respectively comprise openings 526, 528 that are substantially aligned with openings 530 in the carrier support member 516 to provide for receipt of fasteners at locations 518.

The depicted interconnect assembly 500 also may comprise a plurality of insert members 532 each located within an interior defined by one of the conductors 512 and configured to expand or otherwise deform an adjacent portion 533 of the conductor 512. Each of the insert members 532 has a diameter that is greater than a nominal diameter of the tubular conductor 512, as shown by comparing the insert member 532 with non-deformed portions of the conductor 512 located at opposite end portions of the conductor 512. In the manner described below, each insert member 532 is configured to contact the conductor 512 within the interior of the conductor 512 and force the conductor 512 to expand outwardly, in a balloon-like fashion, to an enlarged diameter with respect to the nominal conductor diameter.

In various embodiments, upper and lower plates 522, 524 together define a recess 533 within apertures 520. While recess 533 may be radiused, tiered, beveled or the like, the depicted carrier 514 embodiment defines beveled surfaces 534 on each of the upper and lower plates 522, 524 of carrier 514 at the apertures 520 of carrier 514. Similar to the beveled surfaces 434 of carrier 414, the beveled surfaces 534 define recess 533 at each aperture 520 having a diameter that increases to a maximum value at an interface between the plates 522, 524 from minimum values at the exterior surfaces of plates 522, 524. The maximum diameter of the depicted apertures 520 at or adjacent the interface between plates 522, 524 typically is greater than a maximum diameter of the deformed portions 533 of conductors 512 such that the apertures 520 accommodate the deformed portions 533 of the conductors. As shown, however, the minimum diameter of the apertures 520 at the exterior surface of each of the upper and lower plates 522, 524 typically is less than the maximum diameter of the deformed portions 533 of conductors 512. As a result, each of the conductors 512 preferably is retained within one of the apertures 520 of the carrier 514.

Figure 6C:
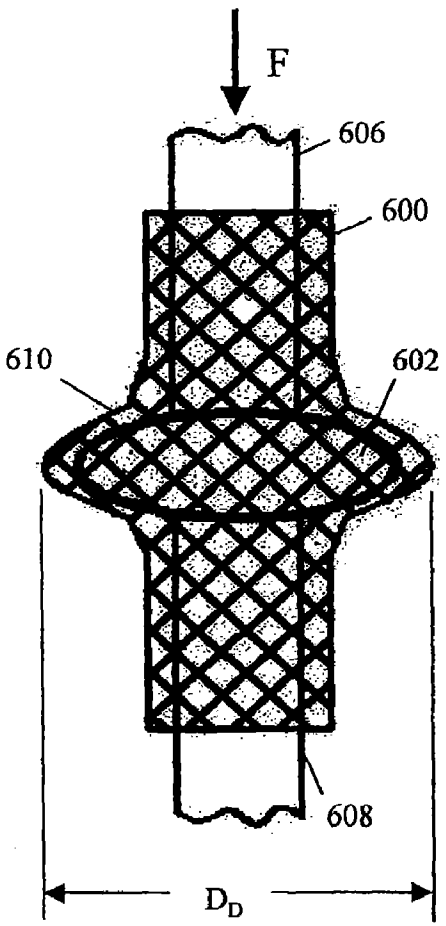
FIGS. 6A through 6C are side sectional views illustrating a method of forming a deformed conductor according to an exemplary embodiment of the invention.
Figure 6B:
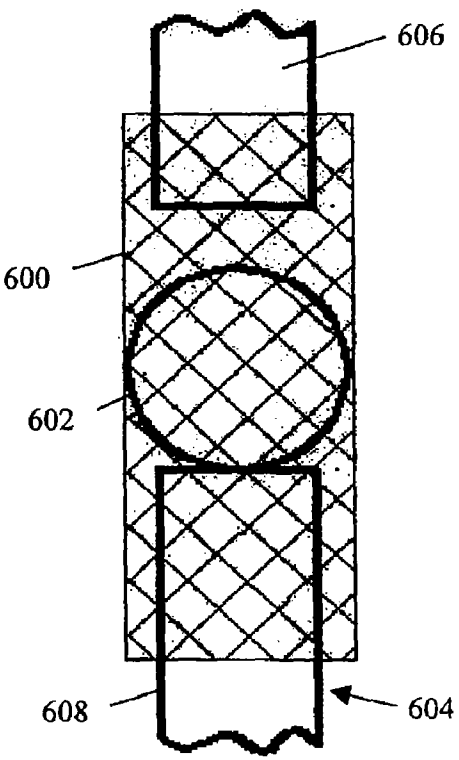
Figure 6A:
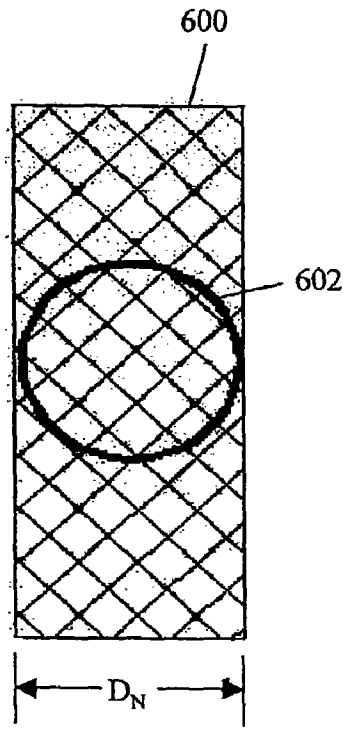

Referring to FIGS. 6A through 6C, there is shown an exemplary method of deforming a conductor, such as the conductors 512 of interconnect assembly 500, according to an exemplary embodiment of the invention. Referring to FIG. 6A, there is illustrated a conductor 600 having a tubular, interlaced-wire construction, such as that of conductor 300 of FIG. 3 for example. The conductor 600 has a nominal diameter $D_N$ and is shown in FIG. 6A in a non-deformed condition. The insert 602 is slidingly placed into an interior defined by the conductor 600 and is located at a preselected location along the length of the conductor 600. As shown, the insert 602 is placed into the conductor 600 with the insert 602 in substantially tubular form. Alternatively, insert 602 may comprises a circular, elliptical, toroidal, or other tapered form to facilitate insertion of insert 602 within conductor 600.

The depicted insert 602 is made from a deformable material (e.g., lead, copper, gold, malleable thermoplastics, etc.). Referring to FIG. 6B, a press apparatus 604 having a movable ram pin 606 configured to apply a force and a back member 608 configured to resist the applied force is provided. As shown, the back member 608 of the press apparatus 604 is inserted into the interior of the conductor 600 to contact a lower surface of the insert 602. The ram pin 606 of the press apparatus 604 is inserted into the interior of the conductor 600 from an upper end of the conductor 600 such that the insert 602 is located between the ram pin 606 and the back member 608.

Referring to FIG. 6C, the ram pin 606 is directed downwardly into contact with an upper surface of the insert 602 to apply an impact force, F, to the insert 602. As shown, the impacting of the ram pin 606 on the insert 602 deforms the insert 602 and an adjacent portion 610 of the conductor 600 as shown. The force, F, may be sufficient to complete the deformation of conductor 600 from a single impact of ram pin 606. In accordance with an exemplary method, multiple impacts may be applied to complete the desired deformation of the insert 602 and conductor 600.

As described above, the depicted insert members 532, 602 comprise a deformable material and may be configured to outwardly expand a portion of the conductors 600 when the inserts 602 are deformed. Inserts 602 made from deformable materials, however, are not required. Other exemplary embodiments are conceived such as an insert 602 comprising a material having a flowable condition and a hardened condition that is injected into the interior of the conductors in the flowable condition. Such a material may comprise, for example, an expandable material that expands automatically upon placement (e.g., expandable foam) or an expandable material that expands in response to exposure to excitation energy (e.g., a material comprising thermally expandable polymer micro-spheres). Furthermore, in other embodiments, insert 602 may be compressed prior to insertion in conductor 600 and expanded thereafter, as with an open cell elastomeric foam member.

Figure 7:
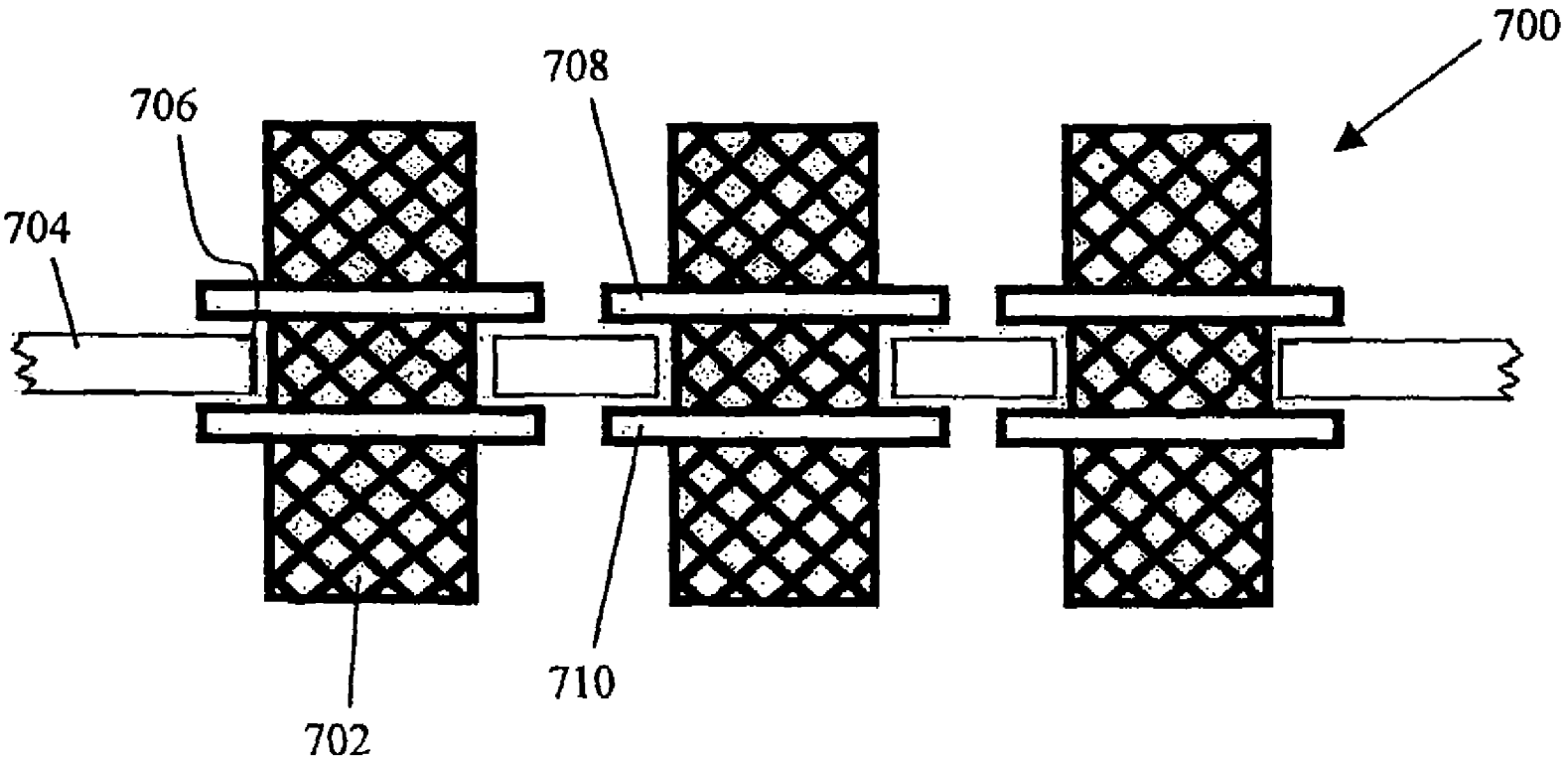
FIG. 7 is a side sectional view of an interconnect assembly according to a third exemplary embodiment of the invention.

Referring to FIG. 7, in accordance with another exemplary embodiment of the invention, an interconnect assembly 700 comprises a plurality of conductors 702 and a carrier plate 704 defining a plurality of apertures 706 in which the conductors 702 are received. In some embodiments, each of the depicted conductors 702 has a tubular, interlaced-wire, construction such as that of conductor 300 shown in FIG. 3. Similar to the conductors of the above-described interconnect assemblies, the conductors 702 are arranged in a spaced arrangement substantially corresponding to a spaced arrangement of electrical contacts of circuit members (e.g., a package and load board). Conductors 702 may be configured to electrically connect with the contacts of the circuit members.

In accordance with an exemplary embodiment of the present invention, the interconnect assembly 700 comprises upper and lower retainers 708, 710 for each conductor 702 (similar to retainer 432 in interconnect assembly 400). The retainers 708, 710 may be resilient retainers. For example, the retainers 432, 708, 710 may comprise O-rings, split rings, crimp rings, shrink tubing, or other structures. In another exemplary embodiment, retainers may be made from non-resilient materials such as deformable plastic, metal split rings, crimp rings, or retainers. In yet another exemplary embodiment, the retainer may comprise a material having a flowable condition and a hardened condition that is placed about the conductor in the flowable condition and hardened.

The upper and lower retainers 708, 710 may be located on each of the conductors 702 at pre-selected locations. For example, retainer 708 may be configured to be located above carrier plate 704 and retainer 710 may be configured to be located below carrier plate 704, such that the carrier plate 704 is located between the upper and lower retainers 708, 710. The distance between retainers 708 and 710 may be equal to or greater than the thickness of carrier plate 704. Furthermore, the apertures 706 of the carrier plate 704 may be dimensioned to define an annular gap between the carrier plate 704 and each of the conductors 702. The upper and lower retainers 708, 710 may comprise a maximum diameter, when they are received on the conductor 702 that is greater than a minimum diameter of the apertures 706.

In accordance with another exemplary embodiment, the interconnect assembly 700 may be configured to hold the conductors 702 in a fixed position relative to the carrier plate 704. Each retainer, e.g., 432, 708, and 710 may be configured to grip (e.g., friction through compressive forces) the conductors at a pre-selected location. Furthermore, the spacing between retainers 708, 710 may be configured to hold conductor 702 in fixed position relative to carrier plate 704. In another embodiment, the spacing between the two retainers 708, 710 may permit some movement of conductor 702 perpendicular to the plane of the carrier plate 704.

Thus, in one exemplary embodiment, the retainers 708, 710 comprise resilient O-rings, split rings, crimp rings, or other structure suitably gripping each conductor 702 and securing each of the conductors 702 to the carrier plate 704. It should be understood, however, that other retainer devices and methods of holding the conductor in a substantially fixed position, relative to the carrier, may be used. In connection with these exemplary embodiments, the construction of the carrier of interconnect assembly 700 is desirably simplified having a single carrier plate 704 rather than upper and lower carrier portions of a carrier attached together and collectively defining the apertures 706 for the conductors 702.

As described above, the interconnect assemblies of the present invention are configured for electrically connecting circuit members (e.g., a semiconductor package and a load board). In applications for package testing, such interconnection may require only short duration connections lasting only seconds or, alternatively, for burn-in testing for example, may last for hours or days. It should be understood that the present invention is not limited in application to package testing and may have other applications including, for example, testing of a wafer prior to singulation of devices from the wafer.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. An interconnect assembly for electrically connecting first and second circuit members, each of the first and second circuit members including an array of electrical contacts, the interconnect assembly comprising:

a plurality of compressible electrical conductors having opposite ends respectively configured for contacting the electrical contacts of the first and second circuit members;

a conductor carrier defining a plurality of apertures for receiving the conductors; and at least one conductor retainer contacting each conductor at a preselected location on the conductor, each conductor retainer having a maximum diameter that is greater than a minimum diameter of the apertures such that a portion of each conductor is retained within one of the apertures.

2. The interconnect assembly according to claim 1, wherein each of the conductor retainers comprises an annular member grippingly received by one of the conductors.

3. The interconnect assembly according to claim 2, wherein each of the conductor retainers comprises at least one of a resilient o-ring, a split ring, a crimp ring, and a shrink tube.

4. The interconnect assembly according to claim 1, wherein the conductor carrier comprises upper and lower members each defining a portion of each of the apertures, and wherein each of the conductor retainers is located within one of the apertures of the conductor carrier.

5. The interconnect assembly according to claim 4, wherein at least one of the upper and lower members of the conductor carrier defines a recess at each of the apertures, the recess comprising at least one of beveled surface, a radiused surface, and a tiered surface.

6. The interconnect assembly according to claim 1, wherein the conductor retainers comprise an upper conductor retainer and a lower conductor for each of the conductors, the upper and lower conductor retainers located on opposite sides of the conductor carrier.

7. The interconnect assembly according to claim 1, wherein each of the conductor retainers comprises an insert member received within an interior defined by one of the conductors, the insert member configured to contact and enlarge a portion of the conductor to a diameter that is greater than a nominal diameter of the conductor.

8. The interconnect assembly according to claim 1, wherein each of the conductors comprises an elongated body portion defining a plurality of openings.

9. The interconnect assembly according to claim 1, wherein each of the conductors comprises an elongated body portion comprising a plurality of interlaced wires.

10. The interconnect assembly according to claim 9, wherein each of the wires extends along a substantially helical path.

11. The interconnect assembly according to claim 8, wherein the elongated body portion of each conductor defines at least one of the opposite ends of the conductor.

12. An interconnect assembly for electrically connecting a semiconductor package to a load board configured for use with a package testing system, each of the package and the load board including an array of electrical contacts, the interconnect assembly comprising:

a plurality of compressible electrical conductors having opposite ends respectively configured for contacting the electrical contacts of the package and the load board;

a carrier defining a plurality of apertures each configured for receiving one of the conductors; and a plurality of retainers each contacting one of the conductors and located within one of the apertures of the carrier, each of the retainers having a maximum diameter that is greater than a minimum diameter of the carrier apertures such that each of the conductors is retained by the carrier.

13. The interconnect assembly according to claim 12, wherein each of the retainers comprises an annular member.

14. The interconnect assembly according to claim 13, wherein each of the retainers comprises at least one of a resilient o-ring, a split ring, a crimp ring, and a shrink tube grippingly received by one of the conductors.

15. The interconnect assembly according to claim 12, wherein each of the retainers comprises an insert member received within an interior of one of the conductors, and wherein the insert member is configured to contact the conductor and outwardly expand a portion of the conductor.

16. The interconnect assembly according to claim 13, wherein each of the conductors comprises an elongated body portion comprising a plurality of interlaced wires.

17. An interconnect assembly for electrically connecting first and second circuit members, each of the first and second circuit members including an array of electrical contacts, the interconnect assembly comprising:

a plurality of electrical conductors having opposite ends configured for contacting the electrical contacts of the first and second circuit members, each of the conductors including a compressible body defining a plurality of openings and an interior;

a carrier defining a plurality of apertures configured for receipt of the conductors; and a plurality of insert members each received within the interior of the body of one of the conductors and configured such that an adjacent portion of the conductor body is outwardly expanded to a maximum diameter that is greater than a minimum diameter of the carrier apertures.

18. The interconnect assembly according to claim 17, wherein the carrier comprises upper and lower plates each defining a portion of the aperture.

19. The interconnect assembly according to claim 18, wherein at least one of the upper and lower plates of the carrier defines a recess at each of the apertures, the recess comprising at least one of beveled surface, a radiused surface, and a tiered surface.

20. The interconnect assembly according to claim 17, wherein the compressible body of each of the conductors comprises a plurality of interlaced wires.

* * * * *